US005176320A

United States Patent [19]

Kraus et al.

[11] Patent Number: 5,176,320

[45] Date of Patent: Jan. 5, 1993

[54] DEVICE AND METHOD FOR MEASURING AND CONTROLLING THE WATER CONTENT IN MAN MADE SNOW

[76] Inventors: Robert A. Kraus; Edmund J. Kraus, both of 1636-T E. Edinger, Santa Ana, Calif. 92705

[21] Appl. No.: 845,608

[22] Filed: Mar. 4, 1992

[51] Int. Cl.[5] ..... F25C 3/04

[52] U.S. Cl. ..... 239/2.2; 239/14.2; 239/63

[58] Field of Search ..... 239/2.2, 14.2, 63

[56] References Cited

U.S. PATENT DOCUMENTS 4,593,854 6/1986 Albertsson ..... 239/14.2

FOREIGN PATENT DOCUMENTS 0202847 11/1986 European Pat. Off. ..... 239/63

8912510 12/1989 World Int. Prop. O. ..... 239/63

*Primary Examiner*—Andres Kashnikow
*Assistant Examiner*—William Grant

[57] ABSTRACT

A noncontact, infrared energy measuring transducer senses the water content in snow by measuring the average intensity of infrared radiant energy emitted by the snow at substantially below freezing temperature, and the intensity of thereon superimposed infrared radiant energy emitted by an amount of water droplets being deposited at/or above freeze point temperature on the surface of the snow. The transducer generates an electric output signal being proportional to the average intensity of the snow emitted infrared radiated energy which is utilized in a servomechanism or sevomotor operated water valve to regulate the water flow in snowmaking systems.

18 Claims, 1 Drawing Sheet

DEVICE AND METHOD FOR MEASURING AND CONTROLLING THE WATER CONTENT IN MAN MADE SNOW

FIELD OF THE PRESENT INVENTION

The present invention relates to a system and method for the automatic control of snowmaking equipment; and more specifically relates to automatic control means for snowmaking devices.

BACKGROUND OF THE INVENTION

In general, snowmaking is accomplished by atomizing water into tiny droplets which are projected through the colder atmospheric air in contact of which the droplets freeze into crystalline particles of ice before falling in the form of man-made snow. A snowmaking device utilizing compressed air to atomize, and to project the atomized water droplets is more specifically disclosed in our earlier U.S. Pat. Nos. 4,759,503; 4,793,554 and 4,915,303. There is, however, a different type of snowmaking machine disclosed in U.S. Pat. Nos. 4,214,700; 4,493,457 and 4,711,395. This type of device utilizes a motor driven fan for moving large volumes of air at ambient temperature to form a semi-coherent stream of air. Virtually all of these types of snowmaking devices comprise at their fan outlet a multitude of high-pressure water atomizer nozzles which disintegrate the device supplied snowmaking water into tiny droplets. The droplets are projected through a predetermined trajectory along which they freeze in contact with the colder air into crystalline particles of ice before falling to the ground. There are, however, climatic conditions such as marginal temperature and/or high humidity which do not allow all the projected water droplets to completely freeze; and thus, a substantial portion of the projected droplets fall unfrozen an the previously fallen snow, thereby causing undesirable snow conditions. The water atomizer nozzles in virtually all fan type snowmaking machines depend on a constant water pressure to produce and maintain a specific droplet size. A single water flow control valve located substantially upstream of the aggregate of atomizer nozzles tends to change the water pressure at each nozzle, and therefore change the water droplet size to an undesirable degree. For this reason, each of the water atomizer nozzles is provided with its own manually operated water valves, the operation of which does not compromise the water droplet size. When the conditions for making snow are marginal, it is necessary that some of the water flow control valves must be manually either opened or closed to compensate for frequently changing atmospheric conditions. That is to say, as e.g., the atmospheric temperature decreases, some of the individual water flow control valves may progressively be opened to cause a greater water flow, thereby producing a greater amount of snow. Whereas, as the atmospheric temperature increases, some of the water flow control valves must progressively be closed so as to limit the total water flow, thereby producing a lesser amount of snow. The individual water flow control valves in the prior art are operated according to fluctuating atmospheric conditions being monitored by means of conventional temperature and humidity gauges, none of which are an integral part of the snowmaking system itself. The condition of the man-made snow in the prior art is therefore solely dependent on how the operator interprets the atmospheric conditions before the snow is made, as well as on an ability to analyze the freshly made snow and consequently on a decision as to whether or not a hydrant readjustment must be made. The main disadvantage of the fan type snowmaking devices of the prior art is therefore their undesirably high labor intensity, as well as being cumbersome and difficult to operate.

In contrast thereto, the method of the present invention utilizes only one continuously operating, noncontact, infrared radiant energy measuring transducer (hereinafter referred to as the IR transducer) which generates an electric output directly proportional to the percentage of water to solidly frozen particles in the snow. The IR transducer produced electric output is utilized in combination with a servomechanism, or servomotor operated water valve to regulate a snowmaking device supplied water flow, so as to automatically produce and to maintain a desired snow condition without human attention.

Accordingly, the present invention in the preferred as well as in the alternate embodiment may be defined as an important improvement embodied in the form of automatic control adaptable to conventional, manually operated snowmaking devices of the prior art; wherein, as the average temperature of freshly made snow decreases, the embodiment of the present invention causes the water flow through the snowmaking device to increase; and conversely, as the average snow temperature increases, the embodiment of the present invention causes the water flow to decrease. Thereby maintaining the fundamentally inverting relationship between the snow temperature and water flow.

SUMMARY

One of the most important aspects in snowmaking is to produce and to maintain a certain snow condition most suitable for the sport of skiing; which requires the ability to determine the percentage of water to solidly frozen particles in the snow. To better understand the principle of how this is accomplished, it should be mentioned that all bodies (not being at absolute zero) emit, in their intensity varying, infrared radiant energy, which may be detected by means of a noncontact, infrared sensing transducer. While not directly being heat, infrared radiant energy may be sensed as such, and therefore may be expressed in terms of temperature. To accurately determine the percentage of water to solidly frozen particles in the snow, it is necessary to consider the average intensity of infrared radiant energy emitted by a well defined surface area of the snow.

The change in the average intensity of the snow surface emitted infrared energy, as well as the operation of the present invention bases on the physical phenomenon, that (depending on the type and amount of nucleating agent in the water), water freezes at a constant temperature of typically 32 degrees Fahrenheit until all of its latent heat has been removed in the process of changing from the liquid to the solid state. After which, upon further removal of heat, the completely frozen water and/or particles of ice may begin to cool to below the water freeze point temperature of 32 degree Fahrenheit. Thus, if e.g., the surface of the snow is completely wet, its temperature will remain at typically 32 degrees Fahrenheit until completely frozen, regardless of the subfreezing temperature of the surface underlying snow. If, however, the surface of dry show at substantially below 32 degree Fahrenheit is steadily sprinkled with droplets of water in their liquid state, the average snow surface temperature will rise with the increasing amount of unfrozen droplets settling on the previously made snow. Conversely, as an increasing amount of yet unfrozen water droplets on the surface of the snow freeze into crystalline particles of ice, the average snow surface temperature will drop with the increasing amount of on the surface freezing droplets. The change in the average snow surface temperature is therefore a function of a change in the total, from a well defined surface area of snow emitted infrared radiant energy. That is to say, the amount of infrared radiant energy being emitted from the surface of the snow at substantially below the freeze point temperature of water, plus the thereon superimposed infrared radiant energy emitted by an amount of water droplets having settled at/or above freeze point temperature on the surface of the snow. The average snow surface temperature is therefore indicative to the percentage of water versus solidly frozen particles in the snow. Since the average snow surface temperature fluctuates within a very narrow band, its monitoring requires a very sensitive instrument such as the noncontact, infrared radiant energy sensing transducer, which represents the most important component for controlling the system for making man-made snow.

OBJECTS OF THE PRESENT INVENTION

It is therefore a prime objective of the present invention to provide means for making continuous, noncontact measurement of the water content in freshly made snow, and to generate a thereto proportional electric output signal which is utilized as a reference signal to control a servomechanism for regulating the water flow in snowmaking equipment.

Another prime object of the present invention is to provide means for automatically regulating a snowmaking device supplied water flow, so as to automatically compensate for frequently changing ambient, and other intrinsic, detrimental conditions while the snowmaking device is in operation.

A still further prime object of the present invention is to provide means for amplifying the snow condition sensor generated electric output; and to invert said output in a manner, so that an increase in the water content of the snow causes a decrease in the snowmaking device supplied water flow; and conversely, so that a decrease in the water content of the snow, causes an increase in the snowmaking devise supplied water flow.

Yet a still further object of the present invention is to provide means for increasing the snowmaking device supplied water flow as the average snow surface temperature decreases; and to decrease the snowmaking device supplied water flow as the average snow surface temperature increases.

The features which we believe to be characteristic of the present invention, both as to their organization and method of operation, together with further objects and advantages will be better understood from the following description in combination with the accompanying drawing which we have chosen for purpose of explaining the basic concept of the invention; it is to be clearly understood, however, that the invention is capable of being implemented into other forms and embodiments by those skilled in the art; which will be fully taken advantage of.

METHOD AND DESCRIPTION OF THE AUTOMATIC SNOWMAKING SYSTEM IN THE PREFERRED EMBODIMENT

Figure 1:
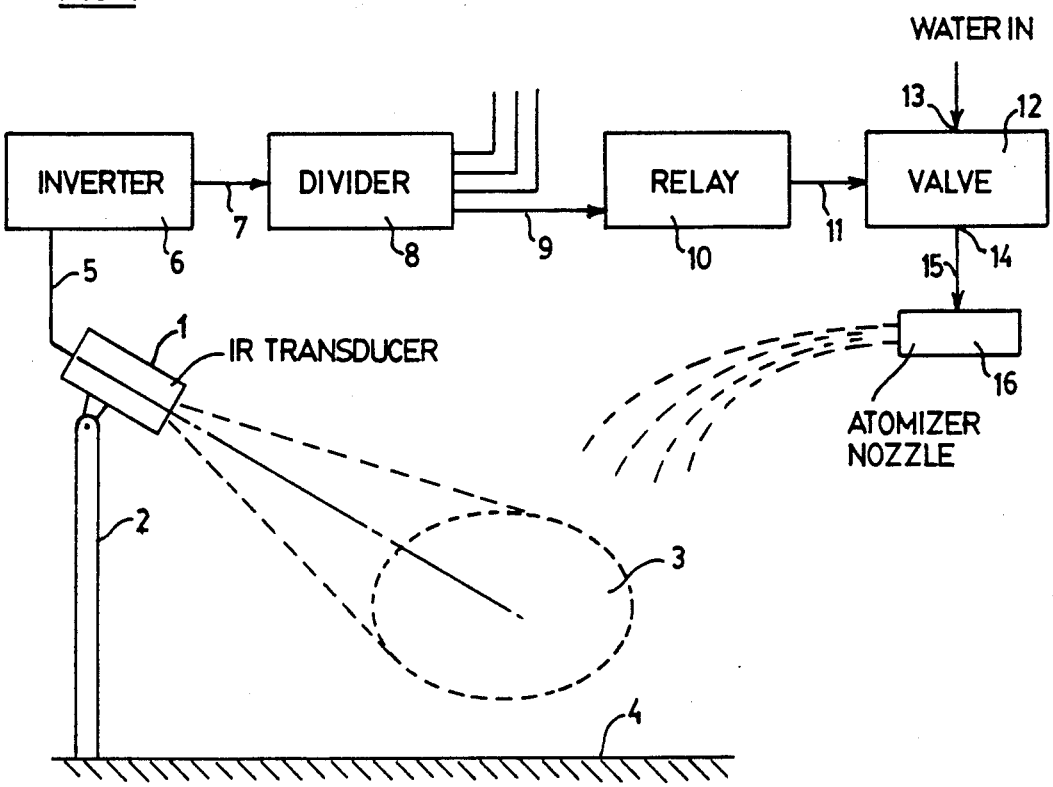
FIG. 1 represents the simplified schematic of the snow making system and incorporated control means in the preferred embodiment of the present invention.

Referring now to drawing FIG. 1. As may be seen, the IR transducer 1 is disposed so as to view from its mounting tower 2 the well defined surface area 3 of the snow 4. By looking at the snow, the transducer senses the intensity of the snow emitted, average infrared radiant energy and generates a thereto proportional electric output signal. The transducer generated electric output signal is transmitted by lead 5 to a first electronic device the inverting amplifier 6 (a first electronic device, hereinafter referred to as the inverter). The inverter serves the purpose of inverting the incoming signal to produce an output signal of nominally equal magnitude and opposite algebraic sign to the input signal, so that, when the transducer generated electric output signal rises, the inverter output signal decreases at an equal rate; and conversely, as the transducer generated output signal decreases, the inverter output signal rises at an equal rate. The inverted and amplified electric output signal is then transmitted by lead 7 to the second electronic devise LM3914N IC chip 8 or alike comprising a voltage divider and 10 comparators which consecutively turn on and stay on until the voltage at lead 7 rises or falls. Thereby providing at leads 9, 10 individual electric outputs, whose collective numbers change with the voltage fluctuation at lead 7. (For purpose of simplicity, only one set of leads 9 and their following in series connected components are, however, shown in the Drawing). Thus, if in a given scenario the voltage at lead 7 rises e.g., to only 50 percent of total span, an aggregate of only 5 collective comparators are turned on, thereby energizing only 5 sets of leads 9, until either the voltage at lead 7 further rises to above 50 percent, or inversely drops to below 50 percent of total span. In which case one or more comparators will consecutively be turned on or off with the rise and fall in voltage at lead 7. Each electric output produced by chips is individually connected by leads 9 to its respective solid-state relay 10 which in turn, is individually connected by lead 11 to its respective solenoid operated water valve 12 having the water inlet 13 and water outlet 14. Each of the solenoid operated water valves in turn, is fluid communicatively connected by pipe 15 to its respective water atomizer nozzle 16. Thus, in the particular scenario where only 5 comparators are energized, only 5 water valves are in the open position and consequently only 5 water atomizer nozzles are supplied with water to be atomized. Any up or downward fluctuation in the voltage at lead 5, will therefore cause either one or more of the water valves to open or to close; and thereby causing the total water flow through the snowmaking device to modulate, so as to compensate for the changing snow surface conditions.

DESCRIPTION OF THE ALTERNATE EMBODIMENT

The alternate embodiment of the snowmaking system of the present invention belongs to the compressed air and water type, and incorporates the same noncontact, infrared radiant energy sensing transducer 17 being incorporated in the preferred embodiment. The IR transducer 17 in the alternate embodiment performs therefore the same function as the IR transducer 1 in the preferred embodiment. The present invention in the alternate embodiment may best be defined as an apparatus for the proportional control of water flow in snowmaking machines. Wherein the noncontact, infrared, radiant energy sensing transducer produces an output signal proportional to the magnitude of the snow emitted, infrared, radiant energy expressible in terms of temperature which is operatively linked to a signal inverting device. The signal inverting device produces an output proportional to the transducer sensed temperature, and having an algebraic sign opposite to the input signal. The so produced output signal is operatively linked to a servomechanism which in turn is mechanically connected to a proportionally operating water valve. The valve position of which is maintained by the optical, linear relationship between the snow conditions and the radiant energy sensing transducer that provides control response information with respect to set point control. Whereby, as the snow surface temperature decreases, the water valve will open until the snow surface temperature reaches equilibrium with a predetermined set point; and conversely, as the snow surface temperature increases, the water valve will close until the snow surface temperature reaches equilibrium with the predetermined set point.

Figure 2:
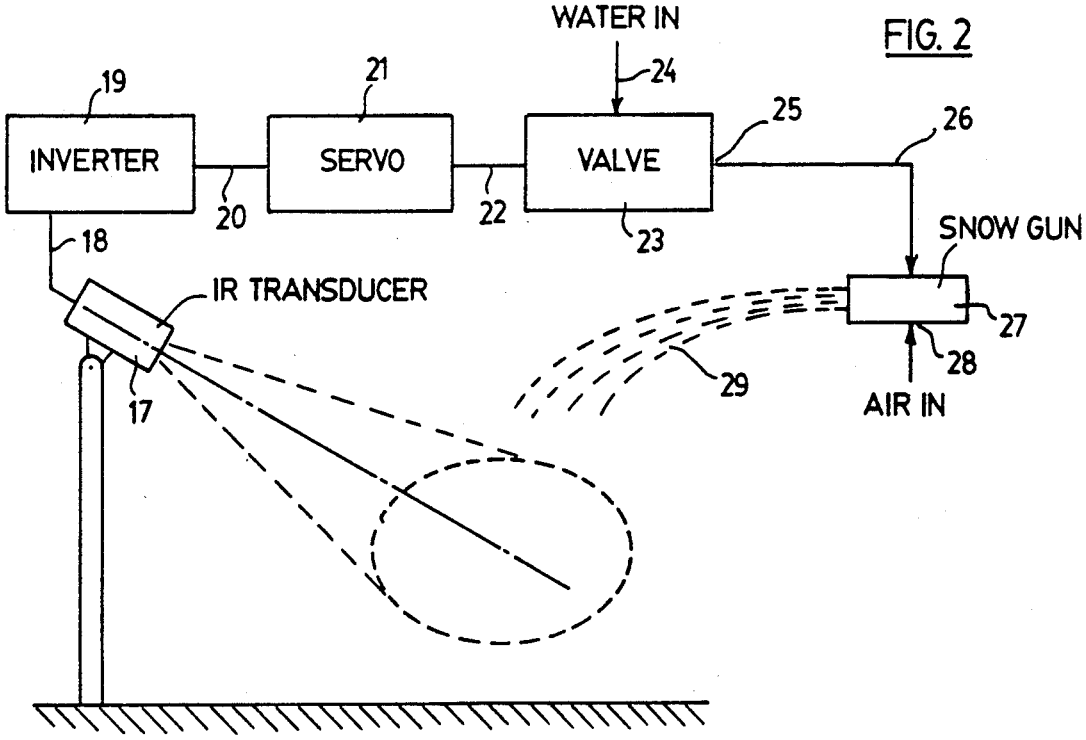
FIG. 2 represents the simplified schematic of the snow making system and incorporated control means in the alternate embodiment of the present invention.

Accordingly, in the alternate embodiment FIG. 2, the IR transducer 17 generates an output signal, (either 0–2 volt, or 4–20 ma) is via lead 18 connected to the inverter 19. The inverted signal is then transmitted via lead 20 to a servomechanism or servomotor 21 which is mechanically connected, by shaft 22, to the proportional water flow control valve 23 having the water inlet 24 and water outlet 25. The water outlet 25 is fluid communicatively connected to the water inlet 26 of the snowmaking gun 27 which also comprises the air inlet 28. The servo mechanism or servomotor is programed so that, when the IR transducer produced electric output signal at lead 18 rises, the servomotor causes the water flow control valve to close, thereby decreasing the water flow at a rate proportional to the rise voltage at lead 18. Whereas, if the electric output signal at lead 18 decreases, the servomotor causes the water flow control valve to open, thereby increasing the water flow at a rate proportional to the drop in voltage at lead 18. In another alternate embodiment, not shown in the drawing the servomechanism is of the pneumatic I/P transducer type, which receives the inverted electric signal and converts it into pneumatic pressure which is fluctuated with the voltage change of the inverted signal. In this configuration, the pneumatic pressure is utilized to operate the water flow control valve so as to increase or decrease the water flow within the snow making gun expelled plume of air and water 29. The fluctuation in the IR transducer generated output signal therefore regulates the amount of snowmaking water so as to produce and to maintain a desired snow condition. The alternate embodiments of the present invention may incorporate a microprocessor to provide a set point capability to produce and maintain a desirable snow condition between wet and dry snow.

What is claimed is:

1. An automatic control means for snowmaking devices; comprising in series connected:

a. a noncontact, infrared radiant energy sensing means being responsive to the intensity of the average infrared radiant energy emitted by a well defined surface of freshly made snow, said sensing means generating an output signal based on said radiant energy emitted by said snow;

b. a first electronic means for receiving and inverting said output signal;

c. a second electronic means for receiving said inverted output signal from said first electronic means, and for dividing said received output signal into a number of individual output signals;

d. a series of electronic relays, each receiving and being responsive to one of said second electronic means divided output signals;

e. a series of electrically operated water valves having a water inlet and a water outlet, each of said valves being responsive to one of said relays; and f. a series of water atomizer nozzles, each being connected to one of said water valves whereby said atomizer nozzles are selectively provided with a flow of water based on the output signal of said energy sensing means.

2. A method for controlling the water flow in snowmaking devices comprising the steps of:

a. measuring the average intensity of infrared radiant energy emitted from a well defined area of freshly made snow by noncontact means and generating an output voltage proportional to said intensity; and b. controlling said water flow in response to said intensity so that an increase in said intensity reduces said water flow, and so that a decrease in said intensity increases said water flow.

3. A method in accordance with claim 2, in which said output voltage is proportionally inverted by an inverting means.

4. A method in accordance with claim 2, in which said output voltage is divided by a voltage divider and comparator means into a number of individual outputs.

5. A method in accordance with claim 4, wherein each of said individual outputs are transmitted to a respective water flow control means.

6. A method in accordance with claim 2, wherein said output voltage is transmitted to a servo mechanism for controlling said water flow.

7. A combined device for measuring the water content in snow by means of temperature measurement and controlling water flow through a water flow control means comprising, operatively in series connected:

a. a noncontact temperature sensing means being responsive to the intensity of snow emitted average infrared radiant energy for generating an output voltage proportional to said intensity;

b. a control means being responsive to said output voltage and having means for selecting a set point, said control means providing an output signal;

c. a servo mechanism for receiving said output signal and converting said output signal into mechanical movement to actuate said water flow control means such that an increase in said output signal reduces said water flow, and a decrease in said output signal increases said water flow.

8. A combination in accordance with claim 7, wherein said control means has set point means for turning on the water flow as the snow surface temperature reaches a selected set point.

9. A combination in accordance with claim 7, wherein said control means has set point means for turning off the water flow as the snow surface temperature reaches a selected set point.

10. An automatic control system for controlling water flow in snowmaking devices; comprising in combination and operatively series connected:

a. a noncontact infrared radiant energy sensing means being responsive to the magnitude of snow surface temperature, said sensing means generating an output signal proportional to said temperature;

b. an inverting means for receiving said output signal generated by said infrared radiant energy sensing means, and for producing an inverted output signal of equal magnitude;

c. a water flow control means being responsive to said inverted output signal for changing the magnitude of said water flow in response to fluctuations in said snow surface temperature.

11. A combination in accordance with claim 10, wherein said output signal is 4 to 20 ma.

12. A combination in accordance with claim 10, wherein said output signal is 0 to 2 volt.

13. A combination in accordance with claim 10, wherein said inverting means is an integral part of said noncontact infrared radiant energy sensing means.

14. A combination in accordance with claim 10, wherein said inverting means is an integral part of said water flow control means.

15. A combination in accordance with claim 10, wherein said inverting means is an inverting amplifier.

16. A combination in accordance with claim 10, wherein said water flow control means is an electric motor operated valve.

17. A combination in accordance with claim 10, wherein said water flow control means comprises transducer means for controlling air pressure to operate said water flow control means.

18. A combination in accordance with claim 10, wherein said infrared radiant energy sensing means is electrically connected to said inverting means; and said water flow control means is electrically connected to said inverting means.

* * * * *